US011927426B2

(12) United States Patent
Luna

(10) Patent No.: US 11,927,426 B2
(45) **Date of Patent: *Mar. 12, 2024**

(54) QUICK RELEASE HOLSTER

(71) Applicant: Comp-tac Victory Gear, Houston, TX (US)

(72) Inventor: Brian Luna, Spring, TX (US)

(73) Assignee: Comp-tac Victory Gear, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/192,159

(22) Filed: Mar. 29, 2023

(65) Prior Publication Data

US 2023/0243618 A1 Aug. 3, 2023

Related U.S. Application Data

(63) Continuation of application No. 17/562,582, filed on Dec. 27, 2021, now Pat. No. 11,644,274.

(60) Provisional application No. 63/131,119, filed on Dec. 28, 2020.

(51) Int. Cl.
*F41C 33/02* (2006.01)

(52) U.S. Cl.
CPC ..... *F41C 33/0227* (2013.01)

(58) Field of Classification Search
CPC .. F41C 33/0263; F41C 33/0227; F41C 33/02; F41C 33/0209; F41C 33/0218
USPC ..... 224/243, 238
See application file for complete search history.

(56) References Cited

U.S. PATENT DOCUMENTS

| | | | | |
|---|---|---|---|---|
| 5,501,381 | A * | 3/1996 | Rogers | F41C 33/0272 224/238 |
| 6,371,341 | B1 * | 4/2002 | Clifton, Jr. | F41C 33/0263 224/242 |
| 6,467,660 | B2 * | 10/2002 | Rogers | F41C 33/0263 224/912 |
| 2007/0181619 | A1 | 8/2007 | Seyfert | |
| 2014/0048572 | A1 | 2/2014 | Yeates | |
| 2020/0232755 | A1 | 7/2020 | Houck | |
| 2022/0099407 | A1 | 3/2022 | Treto | |
| 2022/0107159 | A1 | 4/2022 | Yeates | |

* cited by examiner

*Primary Examiner* — Corey N Skurdal
(74) *Attorney, Agent, or Firm* — NK Patent Law

(57) ABSTRACT

A holster assembly includes a holster having an interior shaped to receive a handgun, and an entrance. An ejection port restraint pivotally connected to the holster includes a latch and is biased toward an obstruction position for engaging the latch with the ejection port of the handgun. A hood restraint pivotally connected to the holster body adjacent the entrance is configured to pivot between a non-obstruction position to permit the handgun to enter and to be drawn, and an obstruction position at which the hood restraint at least partially blocks the entrance. The hood restraint is biased toward the non-obstruction position. A release device mounted on the holster body is configured to actuate both the ejection port restraint and the hood restraint, each toward the respective non-obstruction position thereof, in response to a single movement by a user to allow the handgun to be withdrawn from the holster.

12 Claims, 12 Drawing Sheets

QUICK RELEASE HOLSTER

CROSS-REFERENCE TO RELATED APPLICATION

This application is a continuation application of U.S. patent application Ser. No. 17/562,582, titled "QUICK RELEASE HOLSTER," filed on Dec. 27, 2021, which claims the benefit of priority of U.S. provisional patent application No. 63/131,119, titled "Quick Release Upholster," filed on Dec. 28, 2020, which are all incorporated herein in their entireties by this reference.

TECHNICAL FIELD

The presently disclosed subject matter relates to a quick release assembly that allows for an item to be removed from a repository in an expedited manner. In particular, the presently disclosed subject matter directed to a quick release handgun holster designed to retain a handgun securely and yet to permit rapid withdrawal when required.

BACKGROUND

A wide variety of safety devices exist to inhibit withdrawal of a handgun from a holster by anyone other than the user. Typical rigid polymer holsters utilize retention mechanisms for preventing removal of the handgun that secure the handgun at the trigger guard. Some holsters have more than one retention mechanisms. However, when a holster has more than one retention feature, often mechanisms are either complicated, not reliable, and/or the actuation buttons are readily visible. Some retention mechanisms can become unlocked in a violent attack.

It would be advantageous to provide for an improved holster that overcomes the deficiencies of the prior art by securing a handgun from withdrawal by any but the wearer and yet permits a fast withdrawal upwardly by one trained in using the holster. It would be further advantageous to provide for an improved locking mechanism within the holster that allows the wearer to have a master grip of the handgun at the instant the locking mechanism is disengaged from the holster. It would be furthermore advantageous to provide for an improved locking mechanism that allows the wearer to automatically relock and reholster the handgun securely and quickly if it is not needed in a particular circumstance. For example, a wearer may draw a gun and find that deadly force is not required, and that hand-to-hand action will suffice against a criminal suspect. The wearer would then need to rapidly reholster the gun and relock the locking mechanism without looking but still have the gun secured by a fast acting, self-locking apparatus.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

In at least one embodiment, a holster assembly includes: a holster body having an interior shaped to receive a handgun therein, and an entrance to the interior; an ejection port restraint pivotally connected to the holster body, the ejection port restraint including a latch and being biased toward an obstruction position at which the latch extends into the interior for engaging the latch with the ejection port of the handgun; a hood restraint pivotally connected to the holster body adjacent the entrance, the hood restraint configured to pivot between a non-obstruction position, at which the hood restraint permits the handgun to enter the entrance into the interior and to be drawn from the interior, and an obstruction position at which the hood restraint at least partially blocks the entrance, the hood restraint biased toward the non-obstruction position; and a release device mounted on the holster body and configured to actuate both the ejection port restraint and the hood restraint, each toward the respective non-obstruction position thereof, in response to a single movement of the release device by a user to allow the handgun to be withdrawn from the holster.

The ejection port restraint may include a ramped contact surface that facilitates re-holstering of a handgun by pivoting the ejection port restraint, upon contact with the forward end of the advancing handgun, away from the obstruction position.

The holster body may include a first sidewall and a second sidewall between which the interior is defined; and the hood restraint may be pivotally connected to each of the first sidewall and second sidewall.

The hood restraint may include a first side shield, a second side shield, and a back wall connecting the first side shield and second side shield.

The first side shield may have a forward end pivotally connected to a rearward end of the first sidewall; and the second side shield may have a forward end pivotally connected to a rearward end of the second sidewall.

The hood restraint may include a retention slot that aligns with an arm of the release device when the hood restraint is in the obstruction position.

The release device may be biased rearward to slide a rearward portion of the arm into the retention slot to lock the hood restraint in the obstruction position.

A lower wall of the retention slot may be ramped to increase engagement with a ramped lower side of the rearward portion of the arm.

The release device may be configured to slide by forward user force against a rearward biased force from a rearward restraint locking position to a forward restraint releasing position to actuate both the ejection port restraint and the hood restraint, each toward the respective non-obstruction position thereof.

The release device may include a release lever that extends laterally outward from a side of the holster body. The release device may include a sliding arm connected to the release lever, the sliding arm having a forward portion shaped to pivot the ejection port from the obstruction position to the non-obstruction position when the release device is moved by forward user force from the rearward restraint locking position to the forward restraint releasing position.

The release device may have a release lever that extends laterally outward from the second side of the holster body for access by the thumb of a user.

A safety shroud may have a laterally outward extending lever guard below the release lever for protecting the release lever from accidental or unwanted actuation.

Rearward and forward limits of a range of sliding motion of the release device between the restraint locking position and the restraint releasing position may be defined by contact with respective stop blocks.

The holster body may include a trigger guard cover, defining therein a portion of the interior, for receiving at least a portion of the trigger guard of the handgun, and covering the trigger thereof.

The holster body may include at least one sidewall on which an attachment base is provided for fastening the holster assembly to a host structure or gear item.

The release device may have a release lever that extends laterally outward from the at least one sidewall for access by the thumb of a user when the holster assembly is worn with the attachment base facing the user.

The release lever may be positioned along the user side of the holster assembly for actuation by the thumb of the user as the user grasps the handle of a holstered handgun.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate some, but not all, embodiments and features as briefly described below. The summary and detailed descriptions, however, are not limited to only those embodiments and features explicitly illustrated.

DETAILED DESCRIPTION

Figure 1:
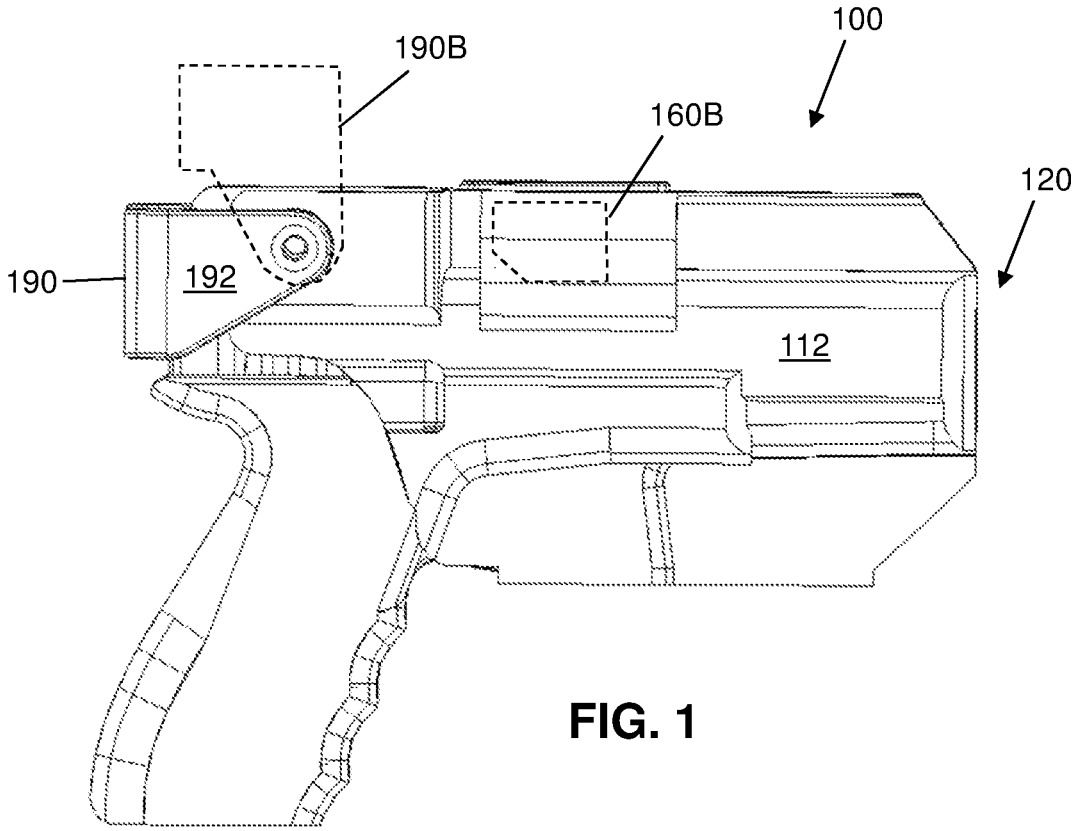
FIG. 1 is a first side view a holster assembly, according to some embodiments of the presently disclosed subject matter, with a handgun holstered therein.
Figure 2:
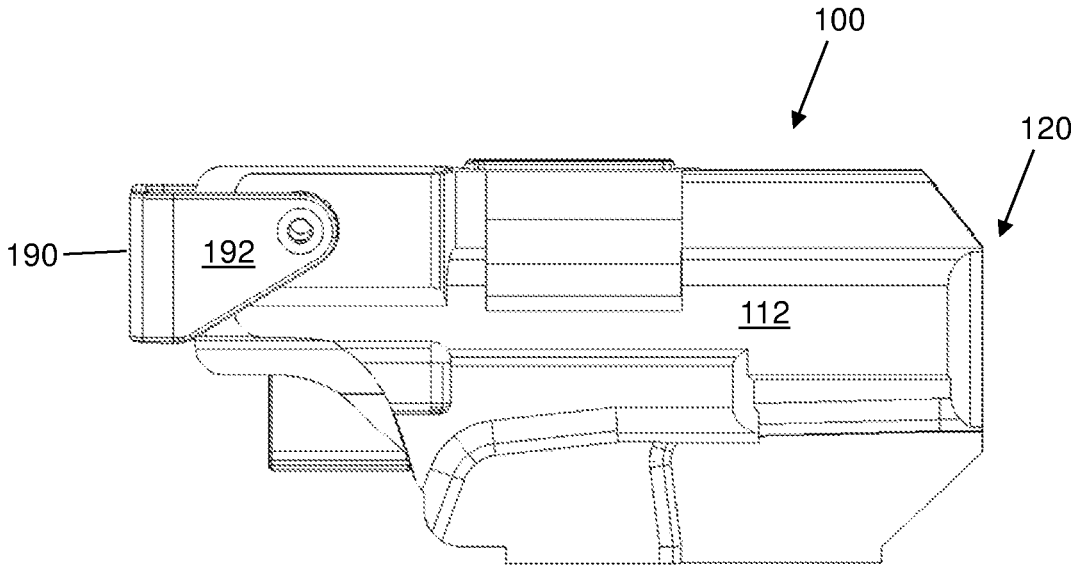
FIG. 2 is a first side view of the holster assembly of FIG. 1, without a handgun.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Unless defined otherwise, technical and scientific terms used herein have the same meaning as commonly understood to one of ordinary skill in the art to which the presently disclosed subject matter pertains.

FIGS. 1-8 illustrate, in various views, an embodiment of a quick release handgun holster assembly 100 configured to receive a handgun 50 (shown in some views) and retain the handgun by two restraints that are commonly actuated by user action on a single release device 130.

When it is time to draw and use a handgun, one of the more important aspects is establishing a quality grip on the handgun. Some instructors refer to this grip as the master grip, which is the interface between the user and the handgun. Master grip is the natural shooting grip. Having a master grip at the moment when the handgun is released from the holster can allow for making precision shots as quickly as possible once the gun is drawn from the holster, facilitating rapid follow up shots, and keeping control of the handgun by the user from a safety standpoint.

The holster assembly 100 advantageously provides an improved thumb-activated release device 130 that advantageously allows the user to obtain a master grip of the handgun in an expeditious manner at the instant the handgun is drawn and disengaged. The holster assembly 100 accordingly allows for the user to grip the handgun in a master grip in a smooth, uncomplicated fashion by providing for a motion that can be intuitively done with no extra unnecessary steps.

Figure 12:
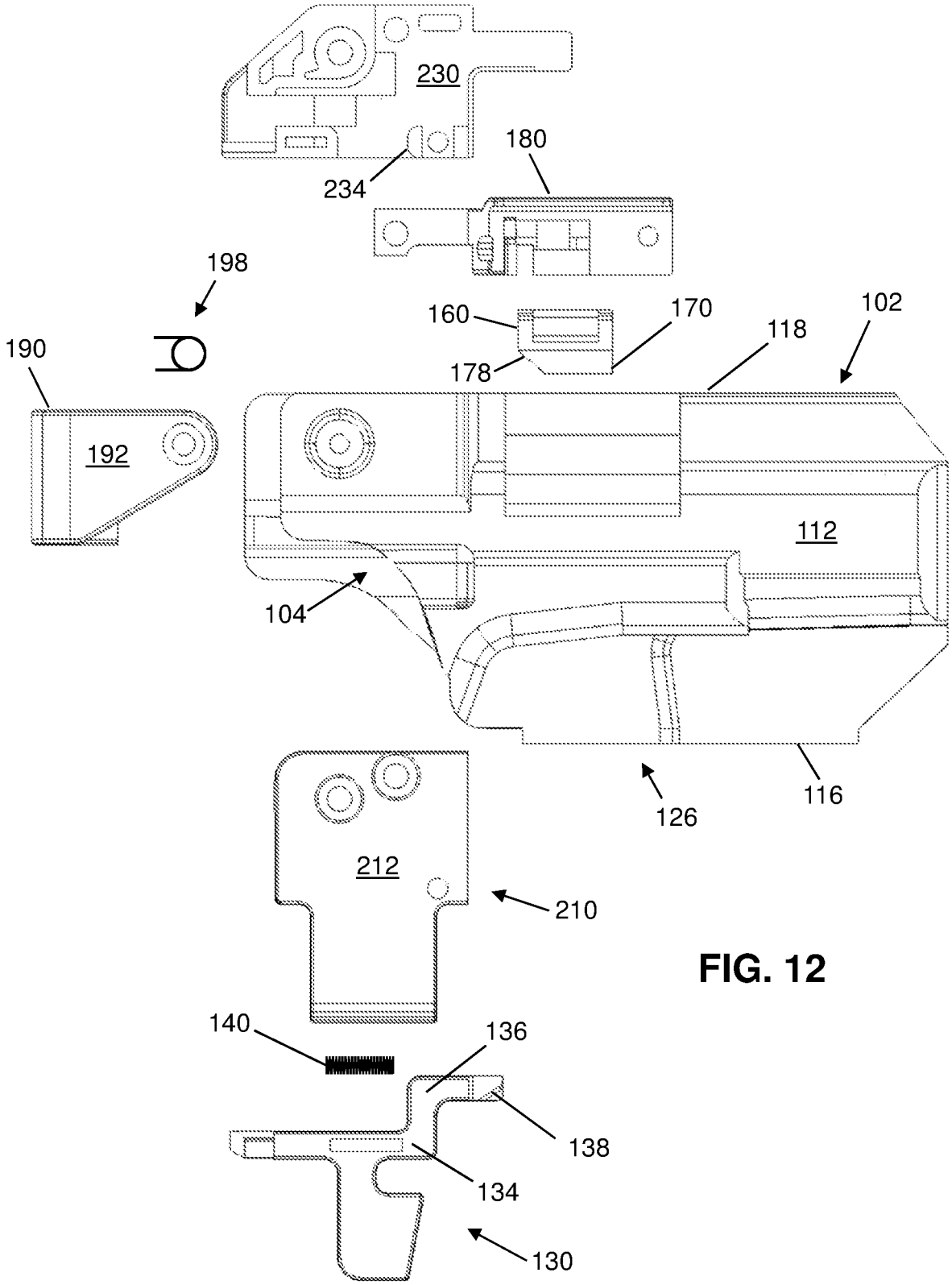
FIG. 12 is a first side view of the holster assembly as in FIG. 2, disassembled for illustration of at least some of the components.
Figure 13:
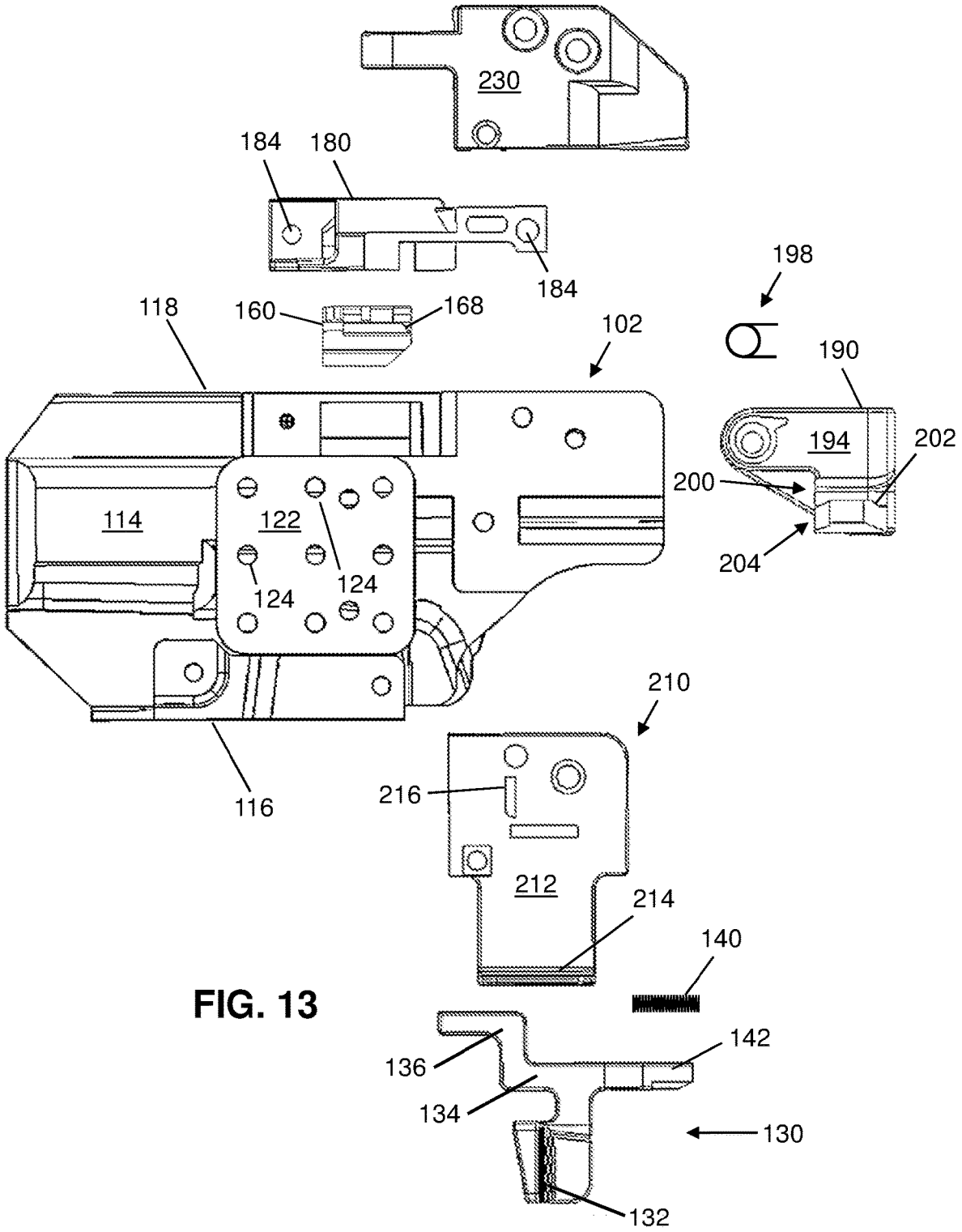
FIG. 13 is an opposite second side view, in relation to FIG. 12, of the disassembled holster assembly.
Figure 14:
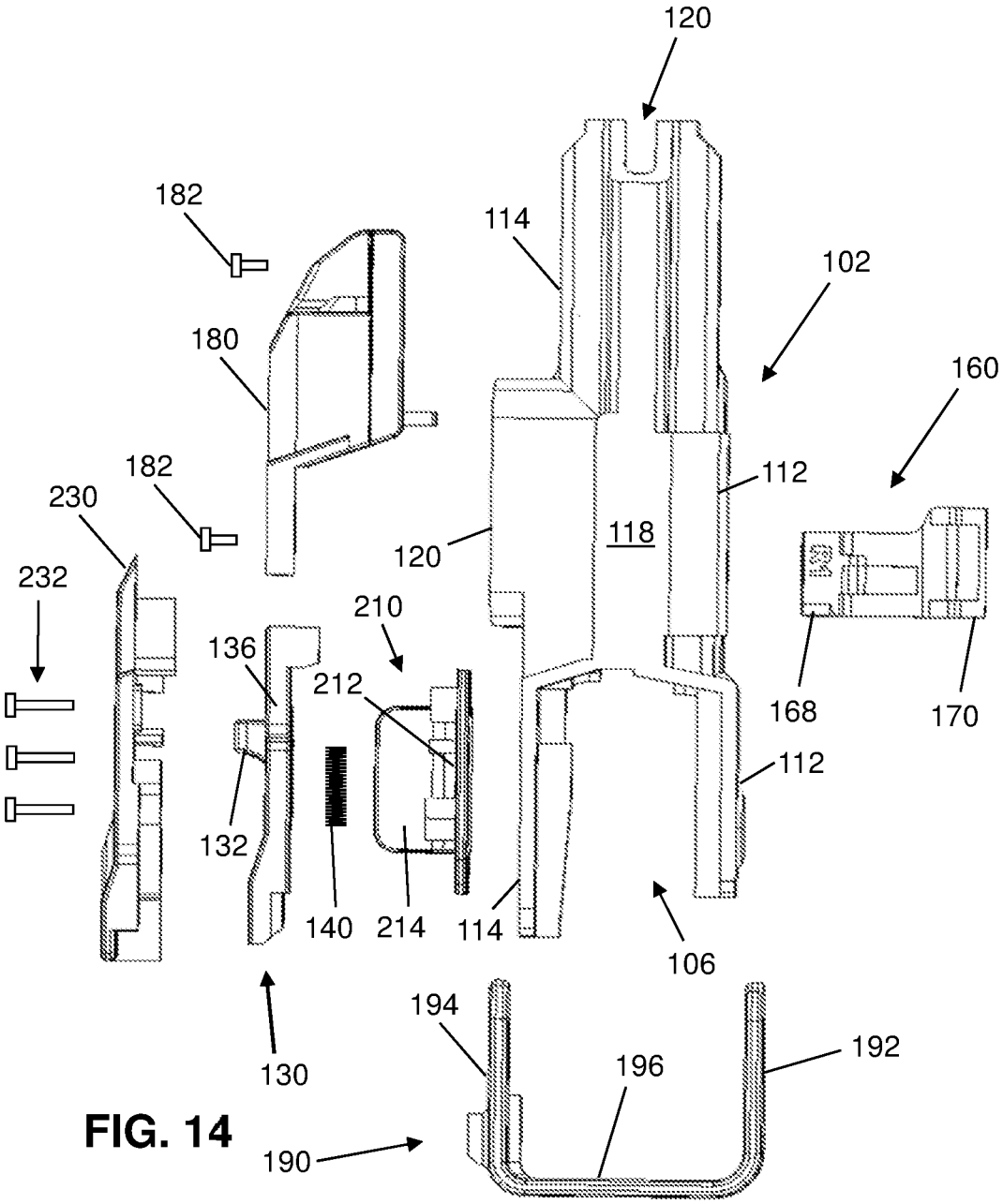
FIG. 14 is a top view of the holster assembly of FIG. 1, disassembled for illustration of at least some of the components.
Figure 15:
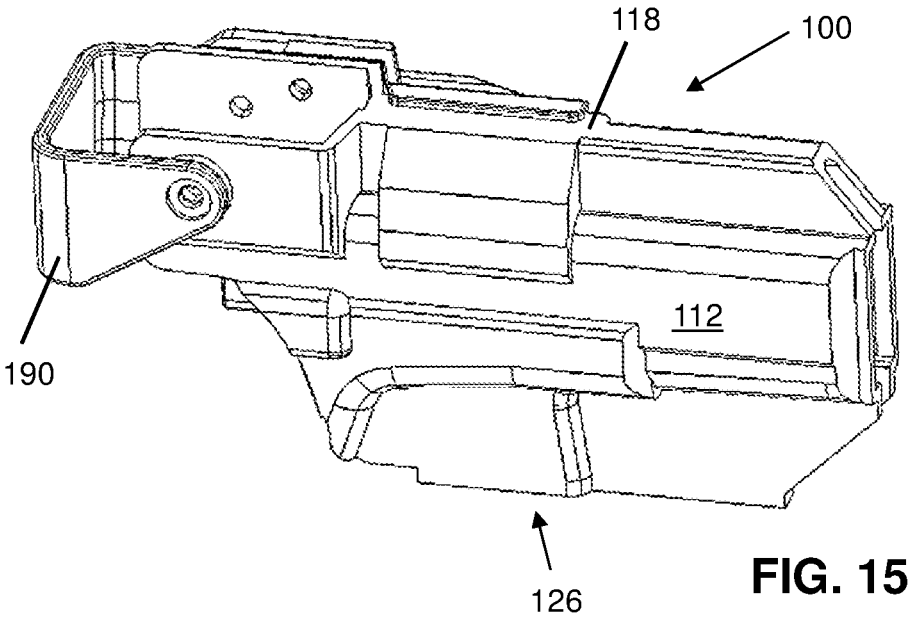
FIG. 15 is a first side perspective view of the holster assembly of FIG. 1.
Figure 16:
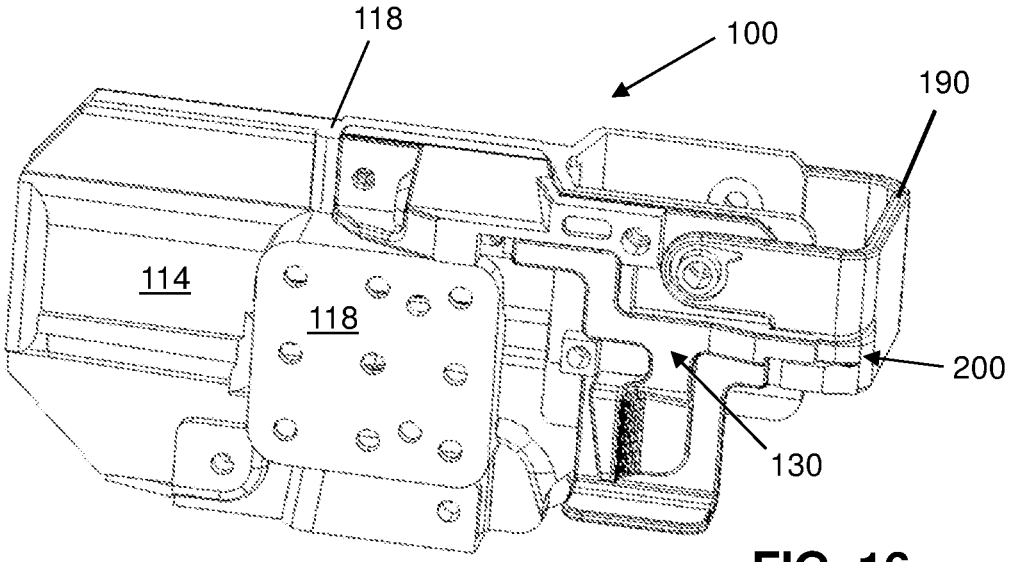
FIG. 16 is an opposite second side perspective view, in relation to FIG. 15, of the holster assembly.

The holster assembly 100 includes generally a holster body 102 (FIGS. 12-14), and, in the illustrated embodiment, an ejection port restraint 160, pivotally connected to a mid-portion of the holster body 102, and a hood restraint 190 pivotally connected to a back portion of the holster body. The holster body 102 is rigidly molded and has an open interior 104 dimensioned to receive the upper portion of a handgun 50, such as the receiver portion of the frame, the barrel, and the slide of a handgun having a reciprocating slide. The holster body 102 thus receives the handgun 50 portions forward and upward from the grip.

A holster assembly 100 according to these descriptions can be tailored to accommodate almost any particular handgun model having an ejection port, and thus the particular dimensions of the holster assembly 100 and its components are not particularly specified, being within ordinary skill to determine and implement in view of these descriptions and drawings for any given handgun.

A longitudinal axis 110 (FIGS. 5-6) extends along the interior 104 of the holster body 102 as defined for intuitive convention along or at least generally parallel to the barrel bore axis of a holstered handgun when present. For further convention, front and forward refer to that end of the holster assembly 100 that receives the muzzle end of a holstered handgun and the direction in which the handgun is advanced into the holster body when being holstered. Similarly, back and rearward refer to an opposite end of the holster assembly 100 proximal the back of the upper portion of a holstered handgun. Top and bottom are conventionally related respectively to the directional senses of the upper sights and grip butt end of a handgun and are similarly termed here in relation to the holster assembly 100. These terms are all relative and nominal, with an understanding that the holster assembly 100, with or without a holstered handgun, may be oriented arbitrarily in handling, transport, storage and use.

Figure 9:
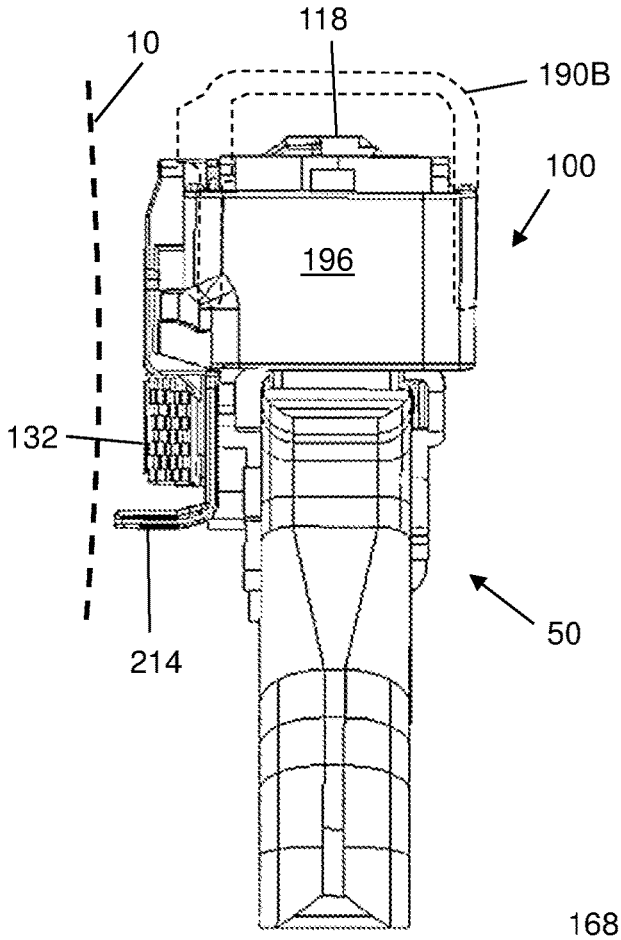
FIG. 9 is a back elevation view of the holster assembly of FIG. 1 and grip end of the handgun, showing a hood restraint of the holster assembly in its obstruction position, and in dashed line, its non-obstruction position.
Figure 10:
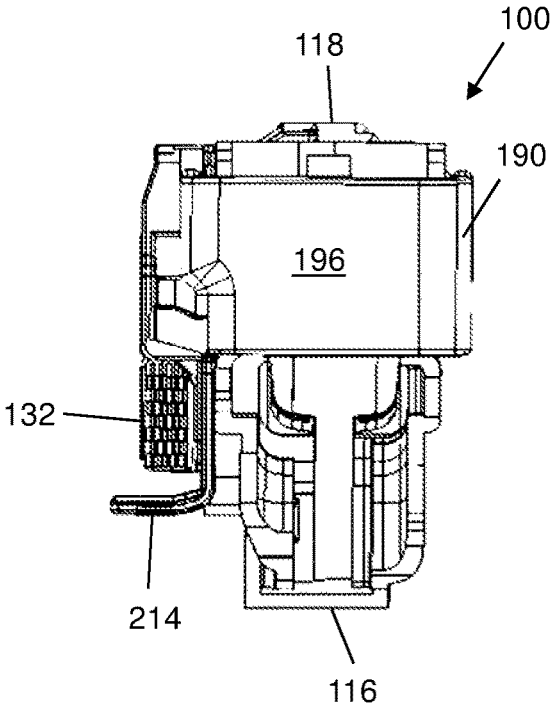
FIG. 10 is a back elevation view of the holster assembly as in FIG. 9.

The illustrated holster body 102 has opposed contoured lateral sidewalls including a first sidewall 112, and a second sidewall 114. In general, the disassembled views of FIGS. 12-14 help illustrate the separately described components. Typically, the first sidewall 112 is considered the outer side of the holster and is worn away from the user's body, while the second sidewall 114 is considered the inner side of the holster body and is worn against or adjacent the user's body 10 (FIG. 9). The two sidewalls are interconnected by a bottom plate 116 and a top ridge 118. The rearward end of the holster body defines an entrance 106 (FIG. 8) for permit holstering of a handgun when the hood restraint is in the non-obstruction position thereof. The forward end 120 of the body is also open, reducing weight and any likelihood of debris accumulating in the interior, and is dimensionally reduced and contoured to block the handgun from over insertion or passing through.

In the illustrated embodiment, the holster assembly 100 includes an attachment base 122 provided at a mid-portion of the laterally outer side of the second sidewall. The attachment base 122 is shown as a rectangular base plate having features, illustrated as a pattern of holes 124 (FIG. 13), for fastening the holster assembly 100 to a host structure or gear item. In various exemplary embodiments, the attachment base can include screws, rivets, snap-together parts, eyelets, or other effects, devices, and/or fasteners for attaching or coupling the holster to a host structure or gear item. In various exemplary embodiments, an item such as a clip, loop, or hook can be mounted on the attachment base and clipped over or onto a belt for waist carry purposes. In further exemplary embodiments, one or more quick-disconnect or other couplings may be provided on or adjacent the first sidewall, and may be permanently or removably coupled to corresponding and cooperating coupling(s) provided on a belt, carrier, gear item, or platform. In still other exemplary embodiments, the holster assembly 100 may comprise an integral belt or one or more connections for attachment to a chest, ankle, leg, shoulder, or other harness or band, or for otherwise securing the holster to a user's person or apparel.

The ejection port restraint 160 is generally an interior component essentially unseen by the user unless peering into the holster assembly 100 unoccupied by a handgun. The holster body 102 serves as a frame for the holster assembly 100. Components termed herein once or more as fixed, such as the fixed base 180 for the ejection port restraint 160, termed fixed base 180 for brevity, are connected directly or indirectly to the holster body 102, and are non-moving relative to the holster body.

Figure 5:
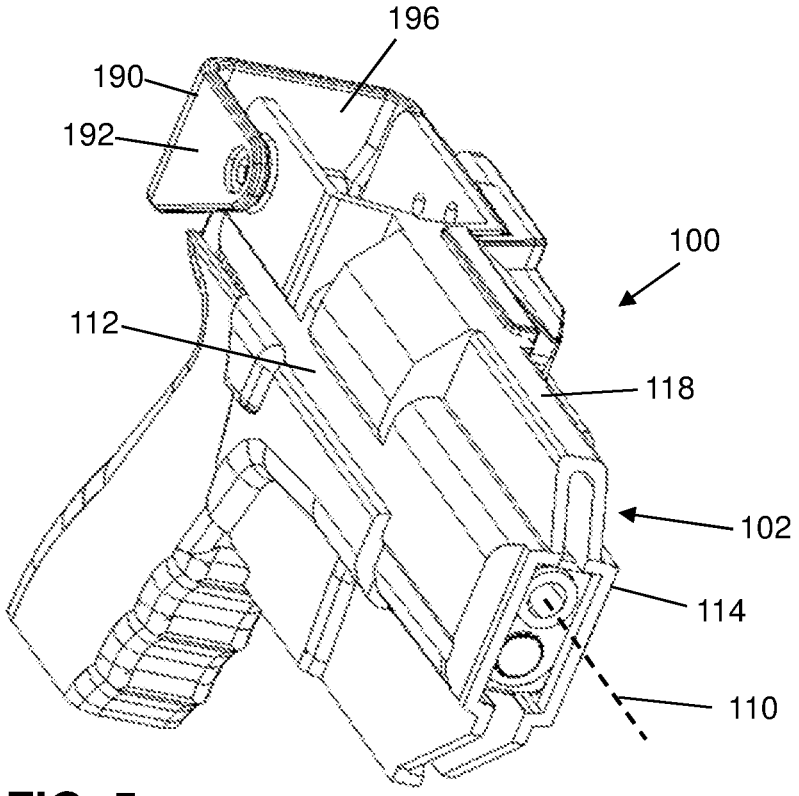
FIG. 5 is a first side and front perspective view of the holster assembly of FIG. 1 showing the muzzle end of the holstered handgun.
Figure 6:
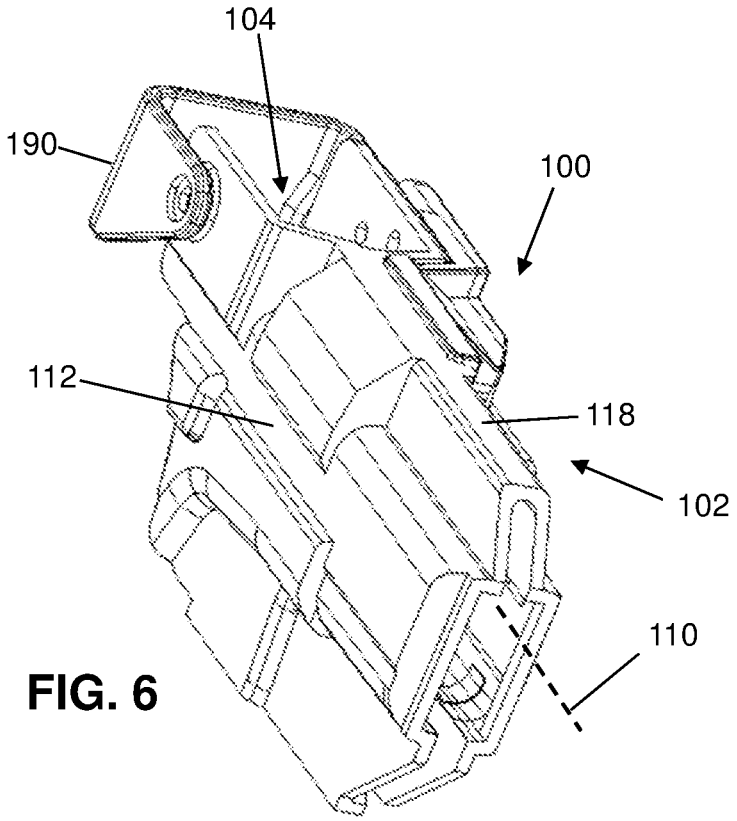
FIG. 6 is a perspective view of the holster assembly as in FIG. 5.
Figure 7:
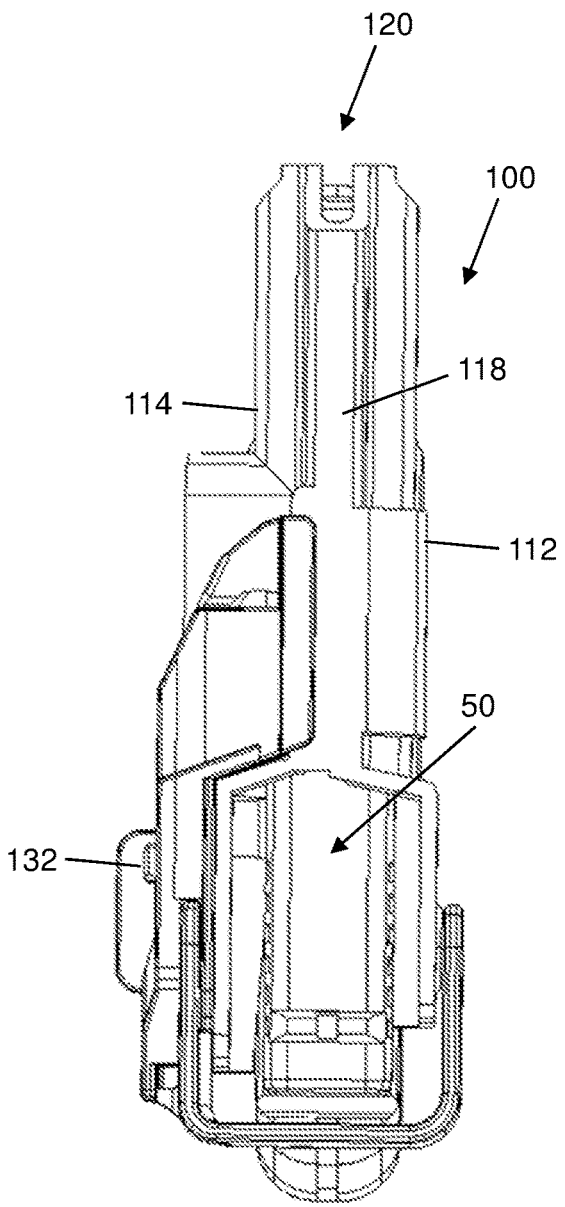
FIG. 7 is a top view of the holster assembly and handgun of FIG. 1.
Figure 8:
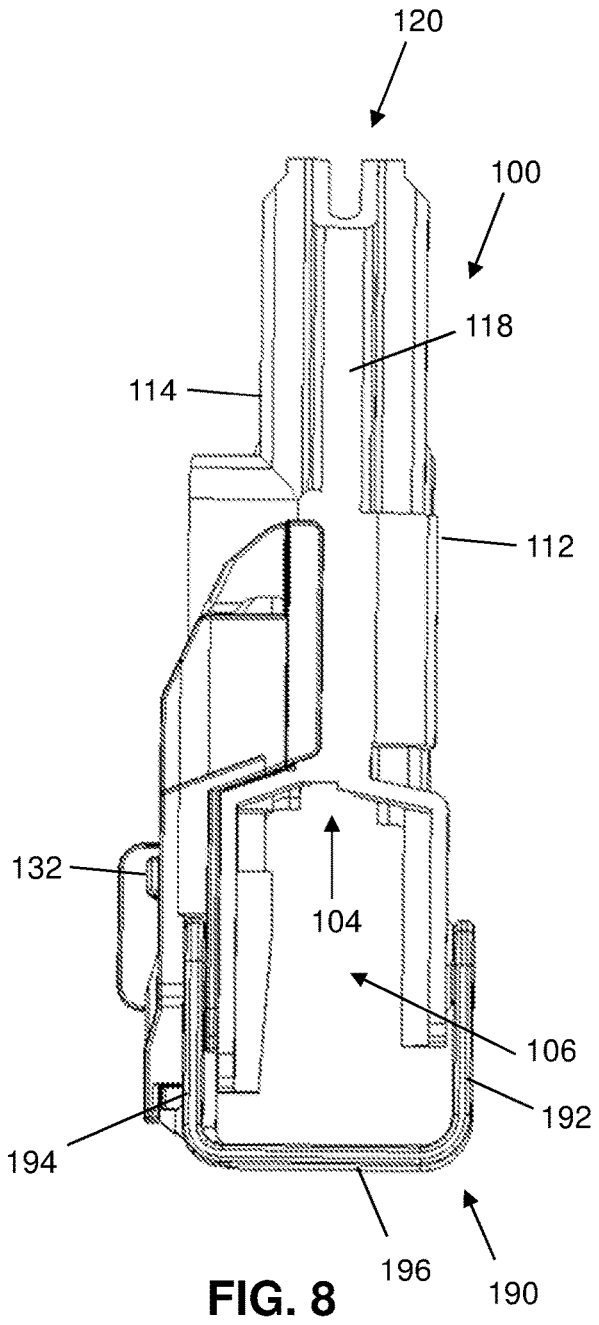
FIG. 8 is a top view of the holster assembly of FIG. 1.
Figure 11:
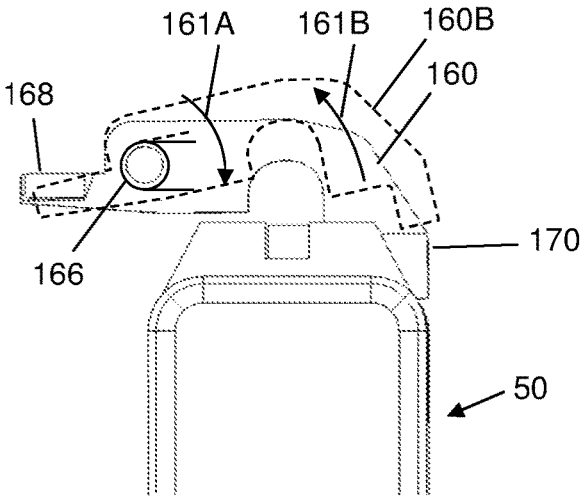
FIG. 11 is a back partial view of the handgun as in FIG. 9, showing an ejection port restraint of the holster assembly in its obstruction position, and in dashed line, its non-obstruction position.
Figure 20:
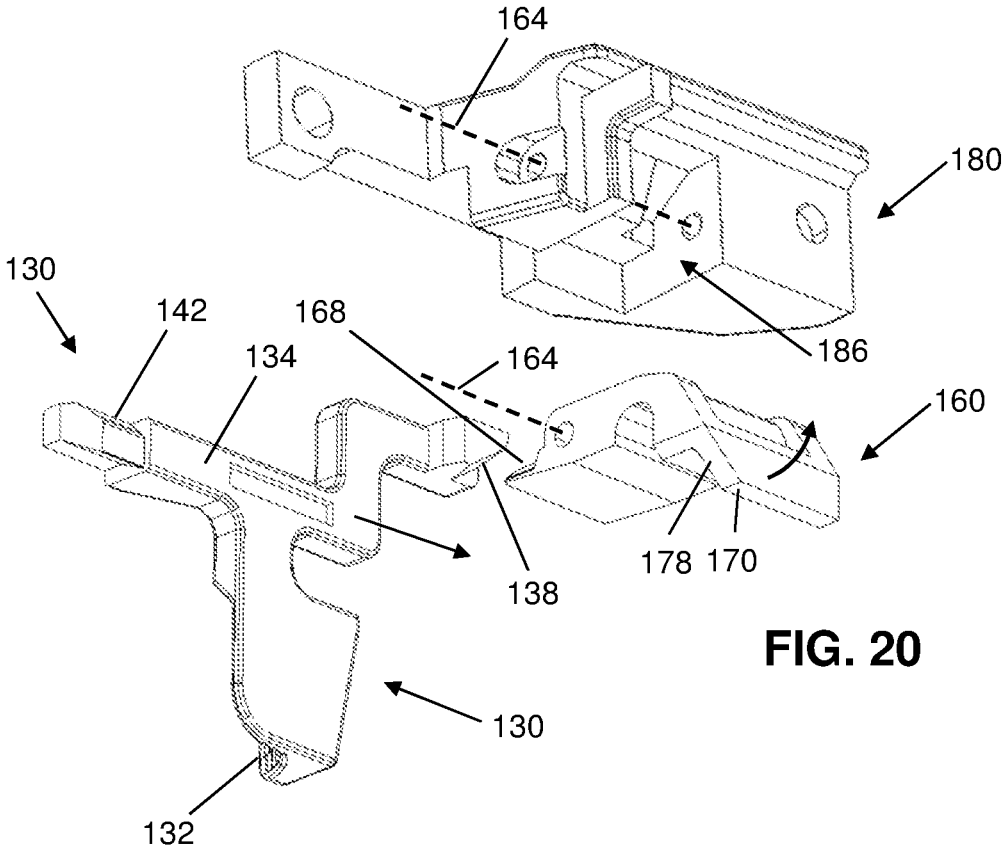
FIG. 20 is a second side and back perspective view of the ejection port restraint in its obstruction position and the release device in its rearward engagement position for illustration of their relation in the holster assembly.
Figure 21:
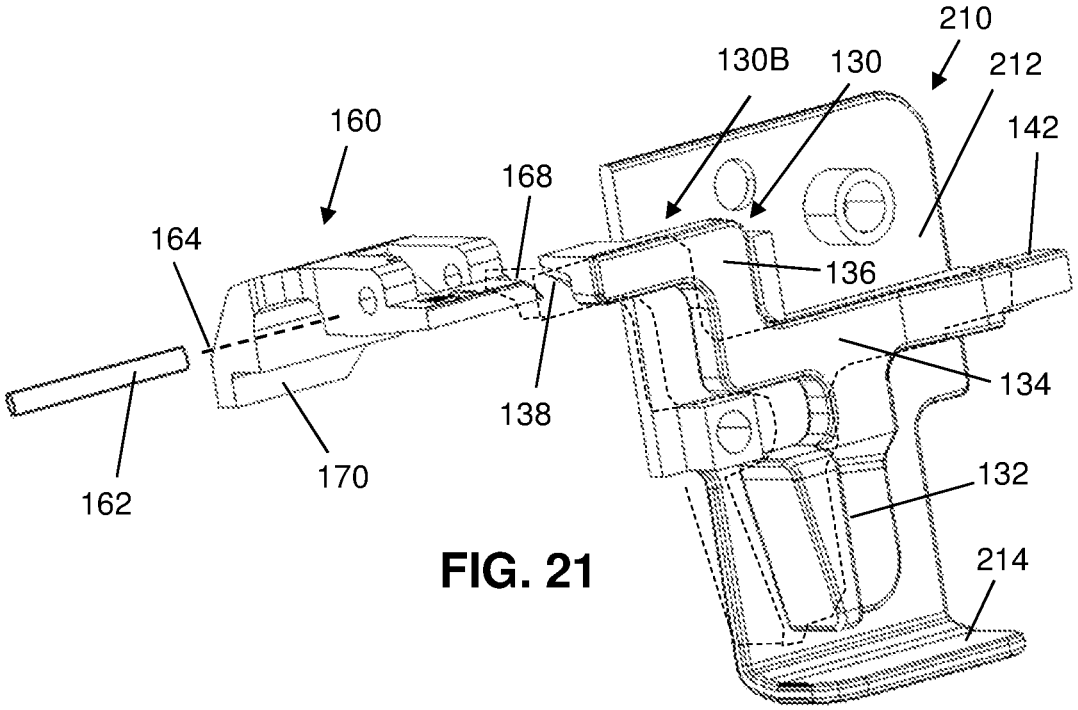
FIG. 21 is a first side and front perspective view of the ejection port restraint and release device as in FIG. 20, showing the release device mounted on a safety shroud of the holster assembly.

The fixed base 180 is mounted on the second sidewall 114 of the holster body 102, for example by fasteners 182 (FIG. 14) through a respective hole 184 (FIG. 13) in each of the forward portion and rearward portion of the fixed base. The fasteners can be bolts, screws, and/or rivets as non-limiting examples. The ejection port restraint 160 is pivotally connected the fixed base 180 and accordingly to the holster body 102 by way of the fixed base. In the illustrated example, the ejection port restraint 160 is mounted on a pin 162 (FIG. 21) extending along a pivot axis 164 parallel to the longitudinal axis 110 (FIGS. 5,6). The pin 162 is captured by the fixed base 180, which has mounting holes aligned along the pivot axis 164. The ejection port restraint 160 is mounted on the pin, which spans a receiving area 186 (FIG. 20) defined by the fixed base 180. The ejection port restraint 160 pivots on the pin 162 between its obstruction position (represented in solid line as ejection port restraint 160 generally) and its non-obstruction position 160B (represented in FIG. 11 in dashed line) around the pin and pivot axis 164.

Figure 19:
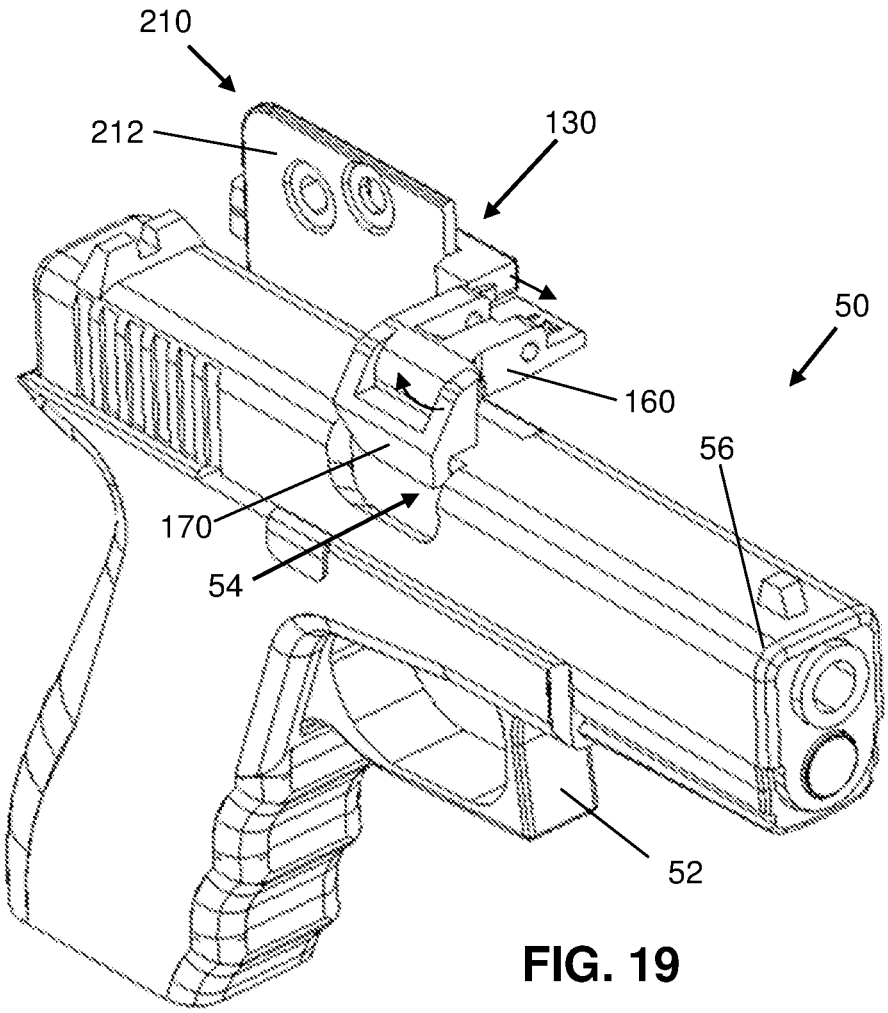
FIG. 19 is a first side and front perspective view of the handgun of FIG. 1, showing the ejection port restraint in its obstruction position engaging the ejection port of the handgun.

The ejection port restraint 160 extends into the interior 104 of the holster body 102. A biasing element 166 (FIG. 11) biases the ejection port restraint into the interior to the obstruction position, such that ejection port restraint engages the ejection port 54 (also referred to herein as an "engagement portion") of the holstered handgun 50 to preclude withdrawal of handgun from the holster assembly. FIG. 19 shows the ejection port restraint 160 engaging the ejection port 54 of the handgun. The biasing element 166, illustrated as a torsion spring in FIG. 11, persistently applies torque from the fixed base 180 to the ejection port restraint 160 to bias the ejection port restraint toward its obstruction position in a first rotational direction 161A around the pivot axis. When a user presses the release device 130 forward, the release device advances to engage and pivot the ejection port restraint 160 toward its non-obstruction position 160B in a second rotational direction 161B around the pivot axis, opposite the first rotational direction. Thus, actuation of the ejection port restraint 160 can be described as motion transfer by which the linear movement of release device 130 by the user is transferred to a corresponding rotational movement of ejection port restraint in such a manner that ejection port restraint 160 disengages from the engagement portion of handgun 50 to thereby permit, in cooperation with the hood restraint 190 reaching the non-obstruction position thereof, withdrawal of the handgun 50 from the holster body.

The hood restraint is also actuated by use of the release device 130. Each of the first sidewall 112 and second sidewall 114 (FIG. 14) has a respective rearward end that together serve as a yoke that spans the entrance 106 to the interior of the holster body and serves as a pivot mount for the hood restraint. The hood restraint 190 is illustrated as a one-piece item having a lateral first side shield 192 and a lateral second side shield 194 connected to together by a back wall 196. The back wall 196 blocks a holstered handgun from withdrawal from the holster assembly 100 when the hood restraint is in it obstruction position as in FIG. 9. The forward end of the first side shield 192 is pivotally connected to the rearward end of the first sidewall 112, and the forward end of the second side shield 194 is pivotally connected, directly or indirectly, to the rearward end of the second sidewall 114.

Figure 3:
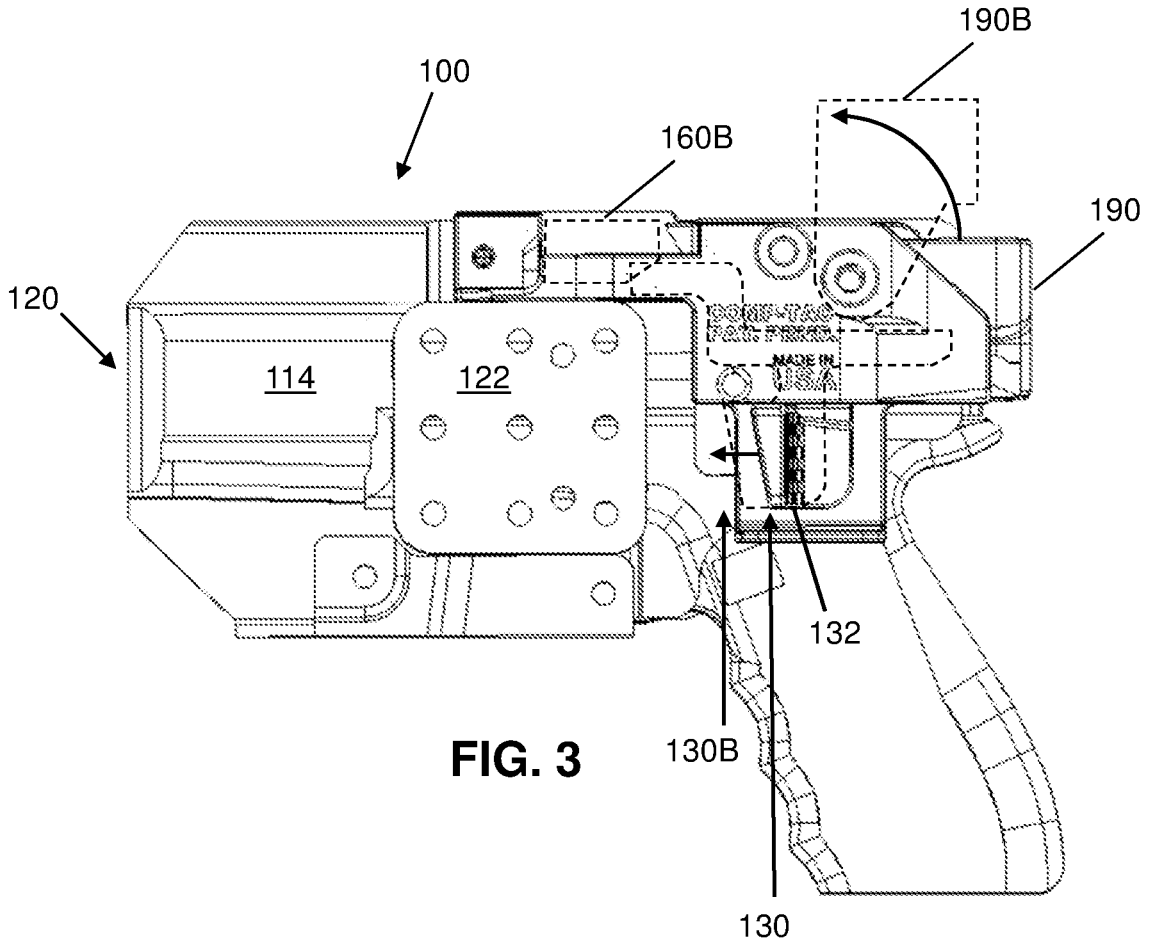
FIG. 3 is an opposite second side view, in relation to FIG. 1, of the holster assembly and holstered handgun.
Figure 4:
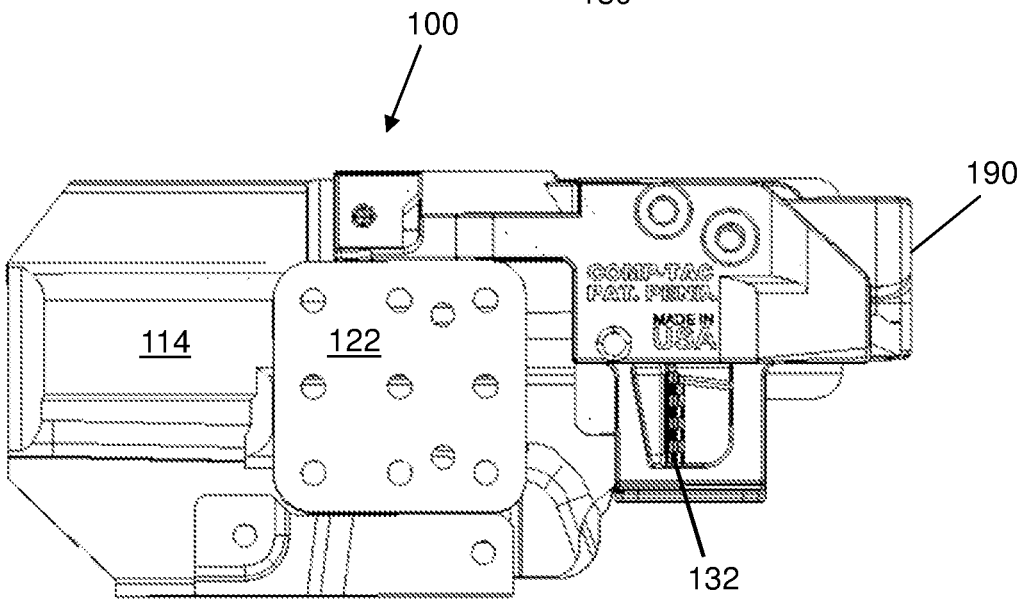
FIG. 4 is an opposite second side view, in relation to FIG. 2, of the holster assembly of FIG. 1.

The hood restraint 190 is configured for swiveling between its obstruction position, shown in solid-line view in the drawings, and its raised non-obstruction position 190B shown in dashed-line view in FIGS. 1, 3 and 9. When in the obstruction position, the hood restraint 190 at least partially blocks the entrance 106 along the longitudinal axis 110 of the holster body 102, thus a holstered handgun 50 is blocked from being drawn by blocking the upper rearward portion, such as the back of the slide, of the handgun. This precludes rearward movement of the handgun.

A biasing element biases the hood restraint toward the obstruction position. The biasing element 198, illustrated as a torsion spring in FIGS. 12-13, persistently applies torque to the hood restraint 190 from the holster body, directly or indirectly, to bias the hood restraint toward its obstruction position 190B in a first rotational direction around a laterally extending pivot axis that is perpendicular to the longitudinal axis of the holster body. When a user presses the release device 130 forward, the release device advances to disengage the hood restraint 190 permitting the hood restraint to pivot upward toward the non-obstruction position.

Thus, both the ejection port restraint 160 and the hood restraint 190 are actuated to their obstruction positions by a single user action on the release device 130. The release device 130 is slidably mounted on the second side 114 of the holster body for access typically by the right thumb of a user. The release device 130 can be pressed forward from a restraint locking position shown in solid-line view in the drawings, and a restraint releasing position 130B shown in dashed-line view in FIGS. 3 and 21.

A biasing element biases the release device 130 toward the restraint locking position. The biasing element 140, illustrated as a linear coil spring in FIGS. 12-14, persistently applies rearward force to the release device 130 from the holster body, directly or indirectly, to bias the release device toward the restraint locking position. The release device 130 can be pressed forward by user action overcoming the rearward force applied by the biasing element 140.

The release device 130 is illustrated as a one-piece item having a release lever 132 that extends laterally outward from the second side of the holster body for convenient access by the thumb of a user. The release lever 132 is illustrated as having a rearward facing cylindrically convex contact pad that is textured for thumb engagement. The top of the release lever 132 is connected to a sliding arm 134, the hooked forward portion 136 of which is shaped to engage and actuate the ejection port restraint 160.

A first lateral end of the ejection port restraint 160 includes a latch 170 that extends variably into the interior of the holster body according to the pivotal position of the ejection port restraint. The latch 170 and is adapted to engage the ejection port of a holstered handgun 50 to preclude removal of handgun from the holster body. The forward end of the hooked portion 136 of the sliding arm 130 has a contact ramp 138 (FIGS. 20-21) for engaging a corresponding contact ramp 168 at the second lateral end of the ejection port restraint. Upon sliding forward motion of the release device 130, the contact ramps 138 and 168 mutually engage and cooperatively lower the second lateral end of the ejection port restraint, thereby pivoting the ejection port restraint 160 from its obstruction position to its non-obstruction position 160B around the pin and pivot axis and withdrawing the latch 170 from the ejection port of the handgun.

In the illustrated embodiment, the ejection port restraint arches over the top of the holstered handgun (FIG. 11) from the second sidewall 114 toward the first sidewall 112, with the contact surface 168 and latch 170 at opposite lateral ends of the ejection port restraint, and the pivot pin therebetween, such that the ejection port restraint operates as a class-one lever. In other embodiments, for example for a left-handed user and a handgun with a right-side ejection port, the holster assembly can be carried on the left side of the user's body. In such an example, the latch 170 still engages the ejection port on the right side of the weapon, but the release lever 132 and latch 170 are on a common side of the holster body. Thus, in such an example, the ejection port restraint need not arch over the top of the holstered handgun.

The forward surface of the latch 170 is perpendicular to would-be rearward motion of the handgun if withdrawn from the holster body 102, improving engagement and withdrawal, especially where the corresponding contact surface of the handgun at the forward end of the ejection port is similarly or partially perpendicular to the barrel bore axis.

Figure 17:
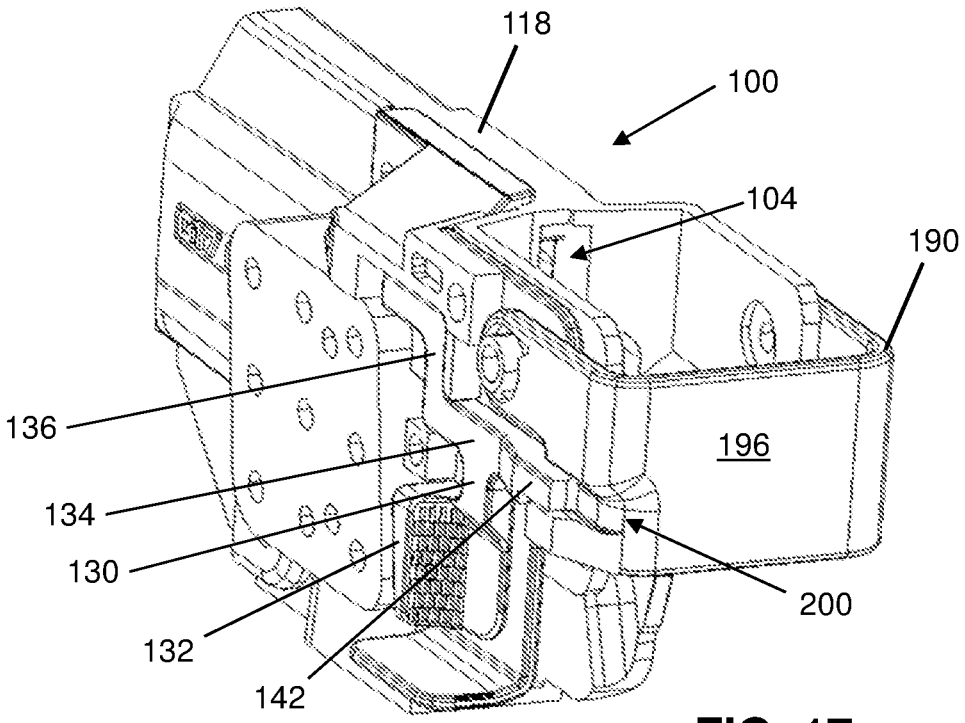
FIG. 17 is a back second side perspective view of the holster assembly of FIG. 1, showing the hood restraint locked in its obstruction position by a release device in its rearward restraint locking position.
Figure 18:
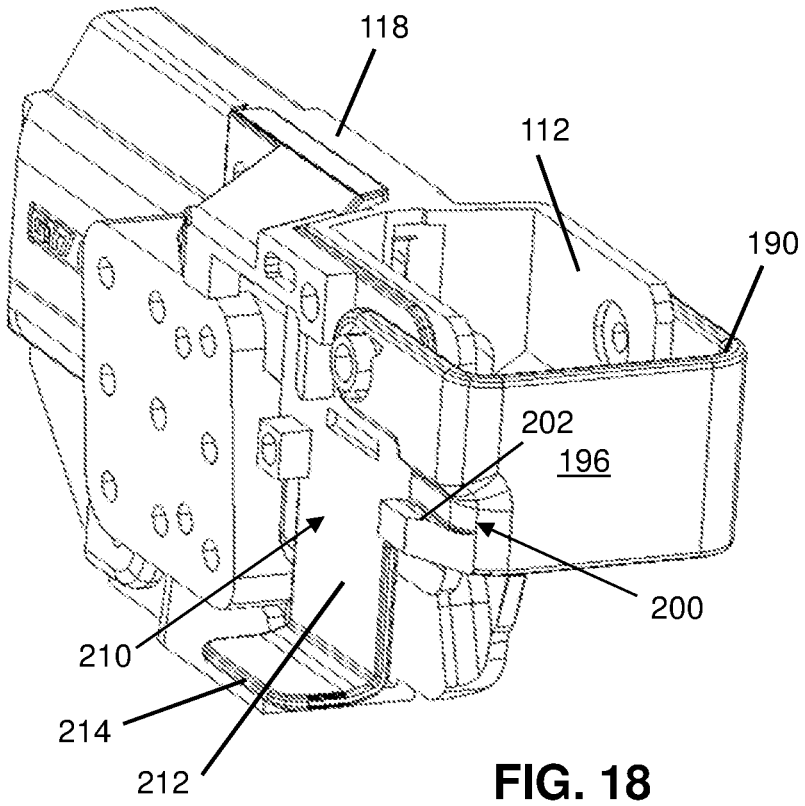
FIG. 18 is a back second side perspective view as in FIG. 17, of the holster assembly without the release device thereof.

The longitudinally extending rearward portion 142 of the sliding arm 134 of the release device 130 is shaped to engage the hood restraint 190, which has an open retention slot 200 for receiving the rearward portion 142 of the arm 134 (FIG. 17). As sliding forward motion of the release device 130 advances by a user pressing the release lever 132, the rearward portion 142 of the arm slides forward in the retention slot, until, as the release device 130 reaches the restraint releasing position 130B (FIGS. 3, 21) the rearward portion 142 of the arm 134 is removed from the retention slot 200. This disengages the hood restraint 190 from the release device 130 thereby instantly permitting the hood restraint 190 to pivot by the torque applied from the biasing member 198 to the non-obstruction position 190B of the hood restraint illustrated in dashed-line view in FIGS. 1, 3 and 9. The hood restraint thereby exposes the rear portion of the handgun 50 and permits its withdrawal from the holster assembly 100. A lower wall 202 of the retention slot 200 is ramped to increase engagement with a similarly ramped lower side of the rearward portion 142 of the arm 134. This enforces the locking of the hood restraint 190 in the obstruction position until the release device 130 is pressed forward, instead of allowing unwanted lateral escape of the rearward portion 142 of the arm 134 from the retention slot 200 by unwanted flexure or plasticity of the components.

In summary, the simultaneous actuation of the ejection port restraint 160 and the release of the hood restraint 190, each to its respective non-obstruction position by user action on the release device 130 frees the handgun 50 for withdrawal from the holster assembly 100 and acquisition of a master grip on the handgun for use when needed.

To holster a handgun, with the hood restraint 190 in the non-obstruction position 190B, the muzzle end of the handgun is inserted into the entrance 106 of the holster body. Lower portions of the first sidewall 112 and second sidewall 114 of the holster body 102 cooperatively form a trigger guard cover 126 (FIG. 12), defining therein a portion of the interior 104 of the holster body for receiving at least a portion of the trigger guard 52 of the handgun 50, and covering the trigger thereof.

The holster body 102 can be contoured and dimensioned to provide custom fit and snug engagement with a particular model of handgun, engaging the handgun at full insertion at multiple contact areas from the muzzle, along the lateral sides, and along the trigger guard within the trigger guard cover. The holster body 102 thus prevents movement of the holstered handgun thereby defining level one passive retention.

The release device 130 need not be depressed by the user for the muzzle of the handgun to pass the ejection port restraint during holstering. Even without the release device 130 being pressed forward, a front portion 56 (FIG. 19) of the handgun makes contact with the ejection port 160 restraint, thereby causing the ejection port restraint to move out of the way (e.g., by pivoting away) to allow handgun to move further into the interior of the holster body. In the illustrated embodiment, the rearward surface of the latch 170 of the ejection port restraint 160 includes a ramped contact surface 178 (FIG. 20) that facilitates re-holstering of a handgun by pivoting the ejection port restraint 160, upon contact with the forward end of the advancing handgun, away from the obstruction position. Once the handgun is fully seated in the holster body 102, the ejection port restraint 160 returns to its biased obstruction position by the torque of the biasing member 166 unless the restraint device 130 is pressed forward by the user.

This causes the handgun to be retained within holster body 102 at least by the ejection port restraint 160 for a second level of retention. That is, during the holstering process, the release device 130, in the restraint locking position, allows the ejection port restraint 160 to pivot from the obstruction position thereof to permit the forward portion of the handgun to pass, and then the ejection port restraint 16 automatically pivots back into the engagement or obstruction position in response to the action of handgun being fully inserted into the holster body to allow the handgun to be secured within holster assembly 100 by the ejection port restraint.

When the handgun is fully holstered into the holster body, the hood restraint 190 can be pivoted from the non-obstruction position 190B to the obstruction position by the user for a third level of retention. To reach the third level of retention, the release device 130 need not be pressed or held forward by the user. The hood restraint 190 can pivoted by hand toward the obstruction position, overcoming the torque applied by the biasing member 198 and loading the biasing member for next use. As the hood restraint 190 approaches the non-obstruction position, an engagement surface 204 (FIG. 13) of the hood restraint contacts the rearward portion 142 of the arm 134 and automatically slides the release device 130 forward against the force of the biasing member 140. When continued user action pivoting the hood restraint reaches the obstruction position, the retention slot 200 aligns to receive the rearward portion 142 of the arm 134 of the release device. The release device than automatically returns rearward to the restraint locking position under the rearward force of the biasing element, sliding the rearward portion 142 of the arm 134 into the aligned retention slot 200, and locking the hood restraint 190 into the obstruction position for the third level of retention.

In the illustrated embodiment, a fixed safety shroud 210 is positioned intermediate the second side wall 114 and release device 130. The safety shroud 210 has a base plate 212 fixed to the rearward end of the laterally outer side of the second sidewall 114. The first side shield 192 (FIG. 14) of the hood restraint 190 is directly pivotally engaged with the rearward end of the first sidewall 112 of the holster body 102. The second side shield 194 of the hood restraint 190 is pivotally engaged with an upper portion of the base plate 212 of the safety shroud, and is thus pivotally engaged with the rearward end of the second sidewall 114 of the holster body via the safety shroud 210. The safety shroud 210 has a laterally outward extending lever guard 214 connected to the lower end of the base plate 212, below the release lever 132 of the release device 130, thus protecting the release lever from accidental or unwanted contact and actuation. The biasing member 140 is captured in cooperating channels defined in mutually facing sides of the base plate 212 and release device 130. The base plate 212 includes a laterally outward extending fixed stop block 216 (FIG. 13) that arrests further rearward movement of the release device at the rearward limit defined by the restraint locking position. Thus release device thus typically rests on the stop block 216 under the rearward force of the biasing element 140.

In the illustrated embodiment of the holster assembly 100, a fixed top cover 230 is mounted laterally outward from the rearward end of the second lateral side 114 of holster body, overhanging upper portions of the safety shroud 210 and release device 130. The top cover 230 thus creates a partial enclosure around the sliding arm 134. The top cover 230 is attached, for example, by fasteners 232 (FIG. 14), and respective holes through the top cover 230 and base plate 212 of the safety shroud 210. A rearward one of the fasteners 232 passes also through the forward end of the second side shield 194, thus serving as a pivotal mount for the hood restraint 190 on the release-lever side of the holster assembly 100. The fasteners 232 can be bolts, screws, and/or rivets as non-limiting examples.

The top cover 230 includes a laterally inward extending fixed stop block 234 (FIG. 12) that arrests further forward movement of the release device 130 at the forward limit defined by the restraint releasing position 130B. Thus, the rearward and forward limits of the range of sliding motion of the release device 130 between the restraint locking position and the restraint releasing position 130B are defined by contact with the stop block 216 and stop block 234 respectively.

In the illustrated embodiment, when the holster assembly 100 is worn, for example at the hip of a user 10 (see FIG. 9), the release lever 132 is advantageously positioned proximate the user's body between the body and handgun 50. This is advantageous toward preventing an aggressor from reaching the release lever and drawing the gun. In various embodiments, the release lever 132 is positioned such as to allow a natural shooting grip on the handgun at an instant at which release lever is moved by the thumb of the user. Accidental discharge that has been reported in prior art level-three holsters is avoided by the holster assembly 100 described herein having a thumb activated release lever 132, instead of an index-finger release. An index-finger operated release can pre-tension the index finger into a firing position thereby potentially contacting the handgun trigger upon drawing the weapon and permitting accidental discharge. By use of the above-described holster assembly 100, the release lever 132 and handgun trigger are actuated by separate digits, for example the thumb and index finger respectively, along opposite sides of the weapon. Thus, as typical users are right-handed shooters, the release lever 132 in the illustrated embodiment is positioned along the user-left side of the holster assembly for actuation by the right thumb of the user as the user grasps the handle of the holstered handgun with his or her right-hand index finger on or adjacent the trigger guard cover 126. This promotes safety against accidental discharges.

Various components of the holster assembly 100, including the holster body and hood restraint, among others, may be formed of injection molded polymers or composite construction. Generally, the holster body and hood restraint will be formed of rigid materials with some resilience. Nylon, polyethylene, epoxy, may be suitable for example; such may be reinforced with glass, carbon, or other fiber materials. Other materials may also be suitable, for example the ejection port restraint, could readily be formed from steel or composite construction-polymer and steel. The several described biasing members can be constructed of, for example, spring steel.

In various exemplary embodiments, the holster body and other components are substantially rigid and is formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, and/or various combinations of the foregoing. Thus, it should be understood that the selection of material or materials used to form holster body and other components is a design choice based on the desired appearance and/or functionality of holster assembly 100.

It should be appreciated that the holster as described can be configured in any desired size, depending on the size of the item to be moved. For example, the holster assembly 100 can have a length and/or height of about 3-6 inches (e.g., 3, 3.25, 3.5, 3.75, 4, 4.25, 4.5, 4.75, 5, 5.25, 5.5, 5.75, or 6 inches). However, the presently disclosed subject matter is not limited and can be configured to be larger or smaller than the range given above. A holster assembly according to these descriptions can accommodate a handgun equipped with one or more attachments, including, for example, a tactical light and/or laser sights. Various models can be available for use with various handguns and their attached items.

According to various embodiments, a method of drawing a holstered handgun includes providing a quick release holster assembly such as the holster assembly 100 described herein. The method further includes applying force by user action on a release lever to actuate the release lever and withdrawing the handgun from the holster assembly. In various embodiments, the method further comprises applying a natural shooting grip on the handgun at an instant the release lever is moved by the user, or at an instant immediately after release lever is moved by the user. In various embodiments, the method further comprises transferring motion to a latch at the ejection port of the handgun, such as by transfer of motion from the moving release lever to a pivoting ejection port restraint. In various embodiments, the method further comprises, by said applying force by user action on the release lever, sliding a portion of an arm in a retention slot, until, as the release lever reaches a restraint releasing position, the arm is removed from the retention slot, thereby disengaging from a pivoting hood restraint, which is biased to pivot a non-obstruction position 190B permitting withdrawal of the handgun by the user.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

These and other changes can be made to the disclosure in light of the Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

What is claimed is:

1. A holster assembly, comprising:

a holster body having an interior shaped to receive a handgun therein, and an entrance to the interior;

an ejection port restraint pivotally connected to the holster body, the ejection port restraint including a latch and being biased toward an obstruction position at which the latch extends into the interior for engaging the latch with the ejection port of the handgun;

a hood restraint pivotally connected to the holster body adjacent the entrance, the hood restraint configured to pivot between a non-obstruction position, at which the hood restraint permits the handgun to enter the entrance into the interior and to be drawn from the interior, and an obstruction position at which the hood restraint at least partially blocks the entrance, the hood restraint biased toward the non-obstruction position; and a release device mounted on the holster body and configured to actuate both the ejection port restraint and the hood restraint, each toward the respective non-obstruction position thereof, in response to a single movement of the release device by a user to allow the handgun to be withdrawn from the holster, wherein the hood restraint comprises a retention slot that aligns with an arm of the release device when the hood restraint is in the obstruction position and the release device is biased rearward to slide a rearward portion of the arm into the retention slot to lock the hood restraint in the obstruction position.

2. The holster assembly of claim 1, wherein the ejection port restraint includes a ramped contact surface that facilitates re-holstering of a handgun by pivoting the ejection port restraint, upon contact with the forward end of the advancing handgun, away from the obstruction position.

3. The holster assembly of claim 1, wherein:

the holster body comprises a first sidewall and a second sidewall between which the interior is defined; and the hood restraint is pivotally connected to each of the first sidewall and the second sidewall.

4. The holster assembly of claim 3, wherein the hood restraint comprises a first side shield, a second side shield, and a back wall connecting the first side shield and second side shield.

5. The holster assembly of claim 4, wherein:

the first side shield comprises a forward end pivotally connected to a rearward end of the first sidewall; and the second side shield comprises a forward end pivotally connected to a rearward end of the second sidewall.

6. The holster assembly of claim 1 wherein a lower wall of the retention slot is ramped to increase engagement with a ramped lower side of the rearward portion of the arm.

7. The holster assembly of claim 1, wherein the release device comprises a release lever that extends laterally outward from a side of the holster body for access by the thumb of a user.

8. The holster assembly of claim 7, further comprising a safety shroud having a laterally outward extending lever guard below the release lever for protecting the release lever from accidental or unwanted actuation.

9. The holster assembly of claim 1, wherein the holster body comprises a trigger guard cover, defining therein a portion of the interior, for receiving at least a portion of the trigger guard of the handgun, and covering the trigger thereof.

10. The holster assembly of claim 1, wherein the holster body includes at least one sidewall on which an attachment base is provided for fastening the holster assembly to a host structure or gear item.

11. The holster assembly of claim 10, wherein the release device comprises a release lever that extends laterally outward from the at least one sidewall for access by the thumb of a user when the holster assembly is worn with the attachment base facing the user.

12. The holster assembly of claim 11, wherein the release lever is positioned along the user side of the holster assembly for actuation by the thumb of the user as the user grasps the handle of a holstered handgun.

* * * * *